US006139124A

United States Patent [19]

Kling

[11] Patent Number: 6,139,124

[45] Date of Patent: Oct. 31, 2000

[54] SUPPORT WITH CARRIAGE FOR THE GUIDANCE OF LOAD LIKE A BOX OR BASKET

[76] Inventor: Bengt Erik Hoger Kling, Munkastigen 23 E. S-575 37, Eksjo, Sweden

[21] Appl. No.: 08/952,963

[22] PCT Filed: Jun. 10, 1996

[86] PCT No.: PCT/SE96/00730

§ 371 Date: Dec. 5, 1997

§ 102(e) Date: Dec. 5, 1997

[87] PCT Pub. No.: WO96/41555

PCT Pub. Date: Dec. 27, 1996

[30] Foreign Application Priority Data

Jun. 9, 1995 [SE] Sweden ..... 9502107

[51] Int. Cl.[7] ..... A47B 88/00

[52] U.S. Cl. ..... 312/323; 312/334.19; 312/334.25

[58] Field of Search ..... 312/322, 323, 312/334.7, 334.18, 334.19, 334.41, 334.42, 334.45, 334.13, 334.1, 334.23, 334.26, 334.24, 334.25, 334.39, 334.27, 334.28; 211/80

[56] References Cited

U.S. PATENT DOCUMENTS

| | | | |
|---|---|---|---|
| 872,225 | 11/1907 | Durham . | |
| 912,328 | 2/1909 | Smithson | 312/323 |
| 1,112,562 | 10/1914 | Rogman | 211/80 |
| 1,197,576 | 9/1916 | Doane et al. . | |
| 1,213,121 | 1/1917 | Mayne | 312/334.19 |
| 1,330,301 | 2/1920 | Brown | 312/323 X |
| 2,005,938 | 6/1935 | Graves | 312/323 X |
| 2,254,832 | 9/1941 | Weight | 312/323 X |
| 2,789,025 | 4/1957 | Regenhardt | 312/334.24 |
| 5,065,920 | 11/1991 | Amner | 312/323 X |

FOREIGN PATENT DOCUMENTS

| | | | |
|---|---|---|---|
| 1238668 | 7/1960 | France . | |
| 348361 | 9/1972 | Sweden . | |
| 929782 | 6/1963 | United Kingdom | 312/323 |

*Primary Examiner*—Janet M. Wilkens

*Attorney, Agent, or Firm*—Greenberg Traurig; Robert P. Bell

[57] ABSTRACT

A stand comprises at least one substantially vertical first portion, carrying at least one first guide, provided to guide the slider between a rear stable first position for a load like a box or basket, and a front second position from which the load can be released from the slider relatively easily, the first guide being designed longitudinally, extending from the rear portion of the stand from a relatively low point, to the front portion of the stand at a relatively high point.

16 Claims, 3 Drawing Sheets

Figure 1
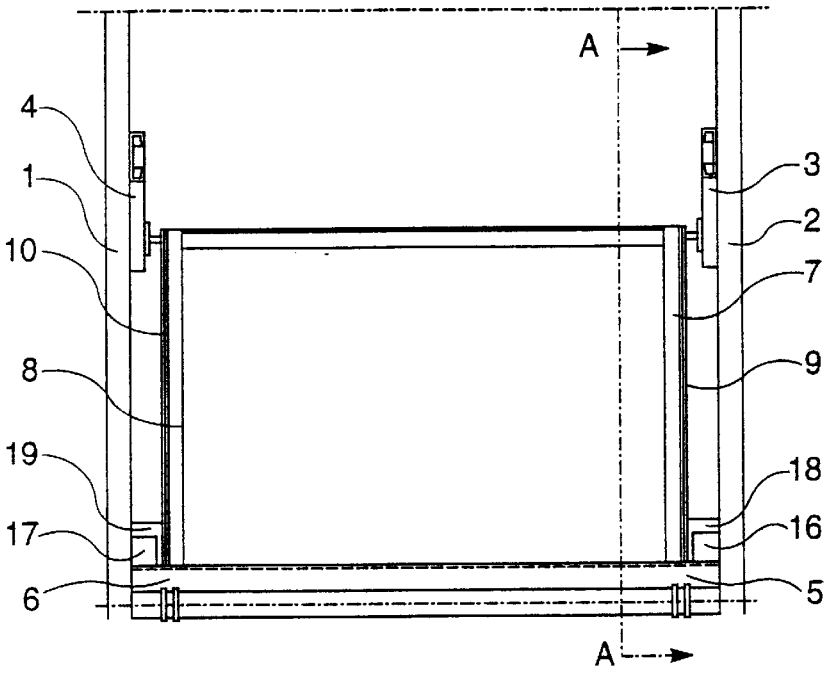
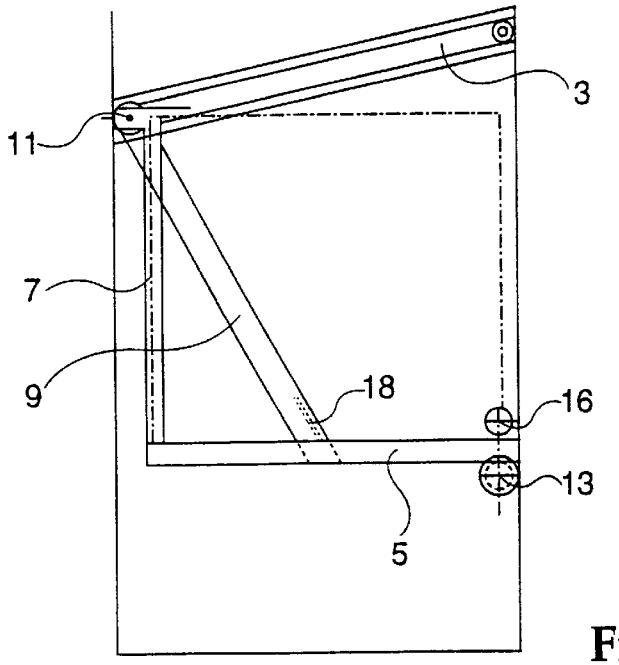
Figure 2

SUPPORT WITH CARRIAGE FOR THE GUIDANCE OF LOAD LIKE A BOX OR BASKET

FIELD OF THE INVENTION

The present invention relates to a stand with a slider. The stand includes at least one substantially vertical first portion, carrying at least one first guide means, provided to guide the slider between a rear stable first position for a load like a box or basket, and a front second position from which the load can be released from the slider relatively easily. The first guide means extends longitudinally from the rear portion of the stand from a relatively low point, to the front portion of the stand at a relatively high point.

BACKGROUND OF THE INVENTION

Stands with sliders are known in the prior art. For example, Swedish publication for opposition No. 348,361 discloses a relatively complicated and thus expensive stand which, due to its complexity has probably not been used too widely.

Other designs are also known, such as French Patent FR 1 238 668. But hitherto, there has been no stand of the prior art which discloses a simple design which is efficient and safe in handling a load. Moreover, in the prior art, no design has been provided where the slider carries a relatively heavy load in a front position without requiring a strong stand design.

SUMMARY OF THE INVENTION

One object of the present invention is to provide a stand with a slider which provides the advantageous features mentioned as lacking in the prior art discussed above.

According to the invention, such a stand with a slider is characterized primarily in that a first guide means is provided in such a way that a relatively low point is located level with the uppermost portion of the slider. In addition, the slider, at its rear portion above the load, is provided with a first guide element cooperating with the first guide means. The stand, at its front portion, is provided with a second guide means for guiding the underside of the slider.

The slider and the guide of the present invention may be designed in many ways within the spirit and scope of the present invention. In one advantageous embodiment, the slider is formed with a vertical rear portion and a horizontal underside. A first guide means may be formed as a rail. The first guide element may be formed as a pulley while the second guide means may comprise a horizontal roller.

Other embodiments may be employed within the spirit and scope of the present invention. For example, a design is conceivable where the stand has only one side portion with respect to only one guide means. In such a case, the guide means may be located above the middle of the slider.

In another suitable embodiment, the stand may comprise two side portions, each of them provided with first guide means while the slider is provided with two corresponding first guide elements.

It may not be necessary to limit the ability to move the slider forwards and downwards, but it may be advantageous to provide cooperating elements at the stand and at the slider to limit movement to a position where the slider tilts forwards and downwards where any load like a box or basket can be easily removed from the slider.

The slider and stand may be suitably manufactured from extrusions preferably from aluminum.

In another advantageous embodiment, the slider may be provided, at its rearmost lowest position with a hinge around which a flap is joined. The flap may act against the force of a spring or the like. The flap may be rotatable from a first, substantially vertical position towards the rear portion of a load, to a second, substantially horizontal position, in which the flap, by means of a stop, prevents the load from moving backwards.

BRIEF DESCRIPTION OF THE DRAWINGS

An example of an embodiment of the present invention will be described in more detail below, reference being made to the enclosed schematical Figures.

FIG. 1 is a front view of an embodiment of the stand of the present invention, illustrating the slider in a first rear position.

FIG. 2 is a cross-section view in the direction of the arrows marked by A—A in FIG. 1.

DETAILED DESCRIPTION OF THE INVENTION

Figure 3:
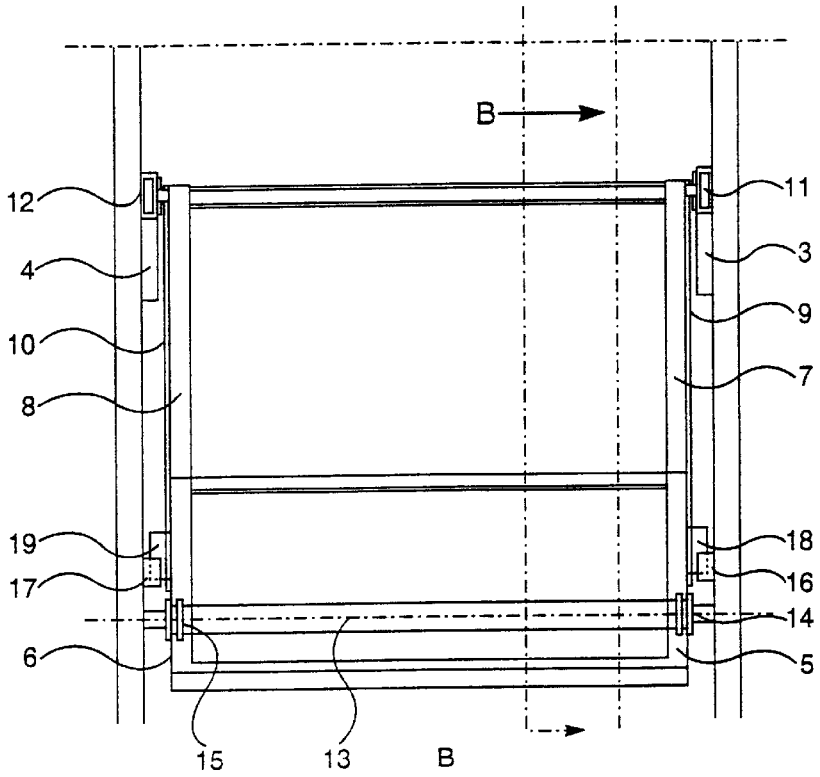
FIG. 3 is a front view of the stand in FIG. 1, illustrating the slider in a second, front position.

FIGS. 1 and 2 illustrate the two sides of the stand. In each of the sides, there are fixed, first guide means 3 and 4, respectively in the form of U-shaped extrusions. Each of first guide means 3 and 4 are fixed at a lower point in the rear of the stand and at a higher point at the front of the stand, such that the guide means rise upwards and forwards in the stand.

The slider comprises left and right horizontal underside portions 5 and 6, respectively and left and right vertical rear portions 7 and 8, respectively. In practice, horizontal underside portions 5 and 6, and vertical rear portions 7 and 8 may be made from extrusions in such a way that horizontal underside portion 5 may be coupled to vertical rear portion 7 by a cross bar 9. Similarly, and horizontal underside portion 6 may be coupled to vertical rear portion 8 by a cross bar 10.

The use of extruded parts keep one side (comprising elements 5, 7, and 9) of the slider together with the opposite side (comprising elements 6, 8, and 10). In the upper part of vertical rear portions 7 and 8 are provided, at each side, respective guide elements in the form of pulleys 11 and 12, respectively. Pulleys 11 and 12 are arranged to run in corresponding first guide means 3 and 4, respectively, each of which has a U-profile for accepting pulleys 11 and 12, respectively.

Between the sides of the stand there is provided, at the front, a horizontal shaft 13 with guide wheels 14 and 15 for guiding the underside of respective slider elements 5 and 6.

Also located at the front portion of the stand are stop lugs 16 and 17 provided to prevent the slider with its cooperating stop lugs 18 and 19 from moving forwards and downwards further than a predetermined position where the load of the slider may easily be removed from the slider.

Figure 4:
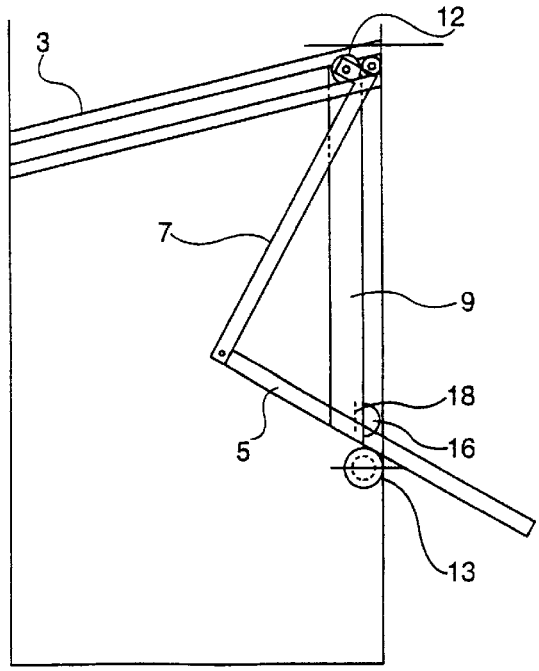
FIG. 4 is a cross-section view in the direction of the arrows marked by B—B in FIG. 3.

The function of the slider is most readily understood from FIGS. 2 and 4. In FIG. 2, the slider is in a first, rearward position, and rests stably with its load in that position. If the slider is drawn forwards, the rear portion will be guided forwards and upwards and the underside will be guided forwards and downwards, such that the slider will tilt forwards and downwards. By locating stop lugs 18 and 19 at the slider suitably, the slider will take such a position, without any significant force, such that loading and unloading of a box, basket or the like will be easy and safe.

Figure 5:
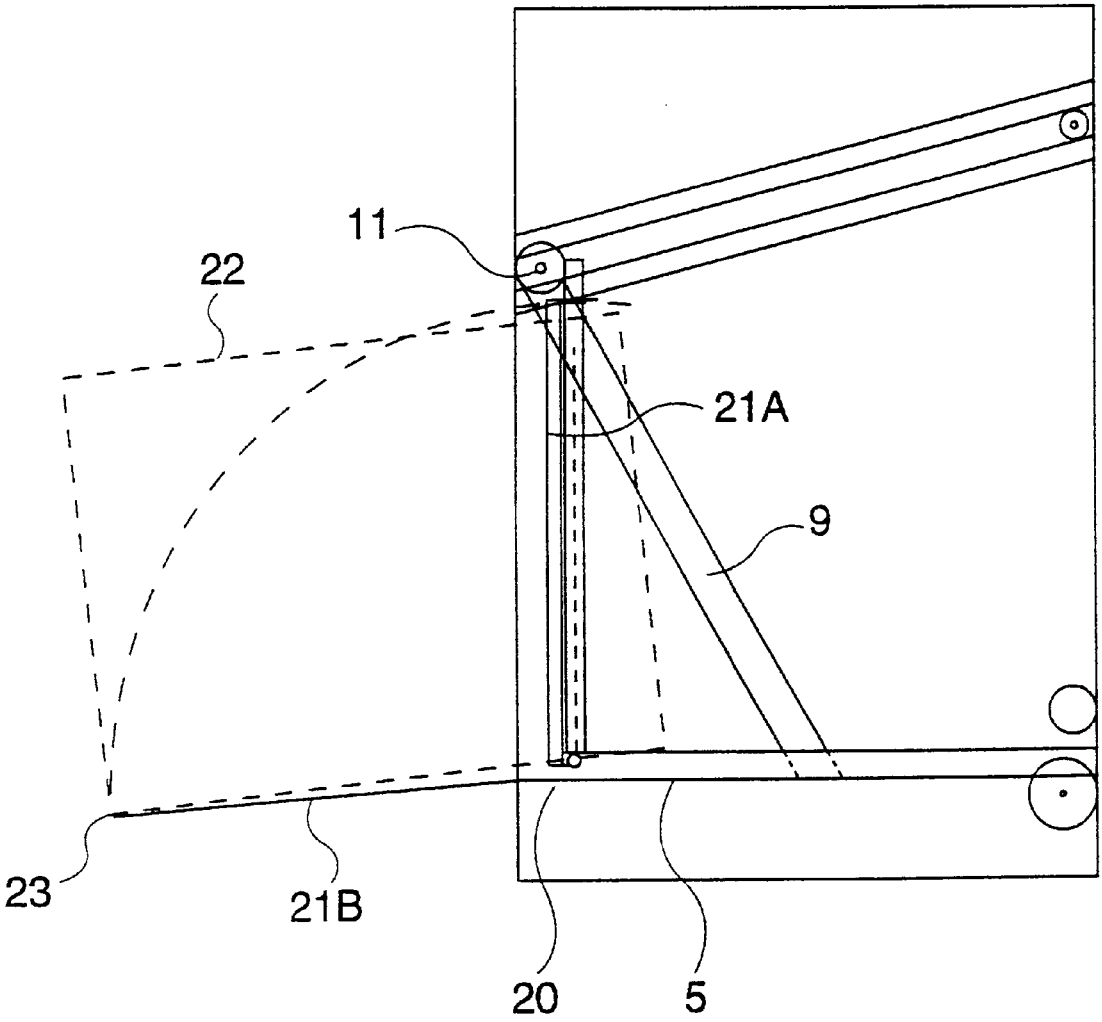
FIG. 5 is a side view of an alternative embodiment of the slider according to the present invention.

The slider, as illustrated in FIG. 5 is provided, at its rearmost, lowest portion with a hinge 20, around which a flap 21A,B is joined. Flap 21A,B is rotatable against the force of a spring or the like, from a first, substantially horizontal position 21A, towards the rear portion of a load 22, to a second, substantially horizontal position 21B, in which the flap by a stop 23 prevents the load from moving backwards.

It is thus possible to draw out the load backwards to a position where is it held in place by the flap. If this flap is pressed down so that the load is released, the load may be lifted out.

While the preferred embodiment and various alternative embodiments of the invention have been disclosed and described in detail herein, it may be apparent to those skilled in the art that various changes in form and detail may be made therein without departing from the spirit and scope thereof.

We claim:

1. A stand comprising:

a slider;

at least one substantially vertical first portion including:

at least one first guide means provided to guide said slider between a rear stable first position for supporting a load and a front second position from which the load can be released from said slider relatively easily, said at least one first guide means extending longitudinally from a rear portion of said stand from a relatively low point, to a front portion of said stand at a relatively high point, said at least one first guide means being provided such that said relatively low point is located level with an uppermost portion of said slider when said slider is in its first position;

said slider comprising, at a rear portion a first guide element cooperating with said first guide means, said first guide element being located on the slider such that when the load is positioned on the slider the guide element extends thereabove; and said stand further comprising a second guide means, provided at a front position of the stand for guiding the underside of said slider.

2. A stand according to claim 1, wherein said slider is provided, at its rear, lowest portion, with a hinge around which a flap is joined, against the force of a spring means, the flap being rotatable from a first substantially vertical position, to a second substantially horizontal portion.

3. A stand according to claim 1, wherein said stand is provided with cooperating elements for limiting movement of said slider forwards and downwards.

4. A stand according to claim 3, wherein said slider is built from one or more extrusions.

5. A stand according to claim 3, wherein said slider is provided, at its rear, lowest portion, with a hinge around which a flap is joined, against the force of a spring means, the flap being rotatable from a first substantially vertical position to a second substantially horizontal portion.

6. A stand according to claim 1, wherein said slider is built from one or more extrusions.

7. A stand according to claim 6, wherein said slider is provided, at its rear, lowest portion, with a hinge around which a flap is joined, against the force of a spring means, the flap being rotatable from a first substantially vertical position to a second substantially horizontal portion.

8. A stand according to claim 1, wherein said slider is provided with a vertical rear portion and a horizontal underside portion, said first guide means comprises a rail, said first guide element comprises at least one pulley, and said second guide means comprises a horizonal shaft.

9. A stand according claim 8, wherein said stand is provided with cooperating elements for limiting movement of said slider forwards and downwards.

10. A stand according to claim 8, wherein said slider is built from one or more extrusions.

11. A stand according to claim 8, wherein said slider is provided, at its rear, lowest portion, with a hinge around which a flap is joined, against the force of a spring means, the flap being rotatable from a first substantially vertical position to a second substantially horizontal portion.

12. A stand according to claim 1 or 8, wherein said at least one substantially vertical first portion of said stand comprises two side portions, each of which is provided with first guide means, and said slider is provided with two corresponding first guide elements, each engaging a respective one of said first guide means.

13. A stand according claim 12, wherein said stand is provided with cooperating elements for limiting movement of said slider forwards and downwards.

14. A stand according to claim 12, wherein said slider is built from one or more extrusions.

15. A stand according to claim 12, wherein said slider is provided, at its rear, lowest portion, with a hinge around which a flap is joined, against the force of a spring means, the flap being rotatable from a first substantially vertical position to a second substantially horizontal portion.

16. A slidable load-carrying apparatus comprising:

a slider having at least one guide element; and a stand for slidably supporting the slider, the stand including:

at least one first guide means, cooperatively engaging said at least one guide element, said first guide means provided to guide the slider between a rear stable first position for supporting a load and a front second position from which the load can be released from the slider relatively easily, the first guide means extending longitudinally from a rear portion of the stand from a relatively low point, to a front portion of the stand at a relatively high point, said the first guide means being provided such that the relatively low point is located substantially level with an uppermost portion of the slider when said slider is in its first position, and a second guide means, provided at a front position of the stand for guiding the underside of the slider, wherein the slider is provided with a vertical rear portion and a horizontal underside portion, the first guide means comprises a rail, the first guide element comprises at least one pulley, and the second guide means comprises a horizonal shaft, wherein the stand comprises two side portions, each of which is provided with one of the at least one first guide means, and the slider is provided with two corresponding guide elements engaging respective first guide means on the stand, wherein the stand and the slider are provided with cooperating elements for limiting movement of the slider forwards and downwards, and wherein the slider is provided, at its rearmost lowest portion, with a hinged, spring-loaded flap, rotatable from a first substantially vertical position, to a second, substantially horizontal portion.

* * * * *